United States Patent [19]

Kimmell

[11] 4,114,952

[45] Sep. 19, 1978

[54] WHEEL ASSEMBLY FOR A SKATEBOARD OR THE LIKE

[75] Inventor: Steven Donald Kimmell, Granada Hills, Calif.

[73] Assignee: Mattel, Inc., Hawthorne, Calif.

[21] Appl. No.: 739,073

[22] Filed: Nov. 5, 1976

[51] Int. Cl.[2] ..... A63C 17/22

[52] U.S. Cl. ..... 301/5.7; 301/37 SC; 301/63 PW; 301/108 SC

[58] Field of Search ..... 301/5.3, 5.7, 63 PW, 301/37 SC, 108 SC, 87; 280/87.04 A; 151/11; 46/221; 16/45–46; 215/221

[56] References Cited

U.S. PATENT DOCUMENTS

| | | | |
|---|---|---|---|
| 1,549,509 | 8/1925 | Schluesselburg | 301/5.7 |
| 2,048,916 | 7/1936 | Bentzlin | 301/5.7 X |
| 2,304,944 | 12/1942 | Martinec | 301/5.7 |
| 2,484,974 | 10/1949 | Van Horn | 301/5.7 |
| 2,622,931 | 12/1952 | Petrelli et al. | 301/5.7 |
| 3,167,105 | 1/1965 | Rosan | 151/11 X |
| 3,554,582 | 1/1971 | Yamashita et al. | 151/11 X |

FOREIGN PATENT DOCUMENTS

| | | | |
|---|---|---|---|
| 1,050,654 | 9/1953 | France | 151/11 |
| 6,752 of | 1914 | United Kingdom | 301/5.7 |

*Primary Examiner*—Robert B. Reeves
*Assistant Examiner*—Charles A. Marmor
*Attorney, Agent, or Firm*—John G. Mesaros; Robert W. Mulcahy; Stephen L. King

[57] ABSTRACT

A wheel assembly for a skateboard or the like, the wheel assembly having a cylindrical hub with a central aperture having a bearing receiving end and an internally threaded end. A tire having a central aperture with a main portion and an enlarged recess adjacent one end thereof, the main portion and the outer surface of the hub being matingly configured to prevent relative rotation therebetween with the tire mounted on the hub. A hub cap is provided with a threaded body for matingly engaging the internally threaded end of the hub, and a cap portion configured for being received within the recess of the tire, the outer periphery of the cap portion and the inner periphery of the recess being matingly configured with coacting ridges and detents so that upon securing the wheel to the hub the hub cap is prevented from loosening.

4 Claims, 14 Drawing Figures

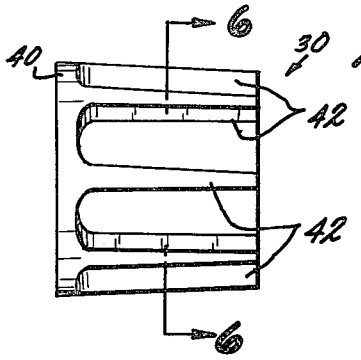
FIG. 3
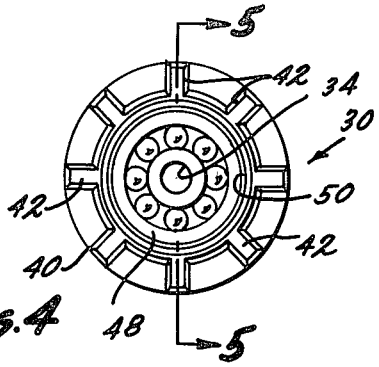
FIG. 4
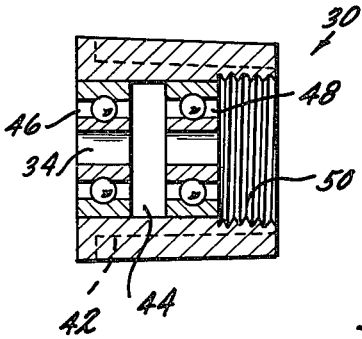
FIG. 5
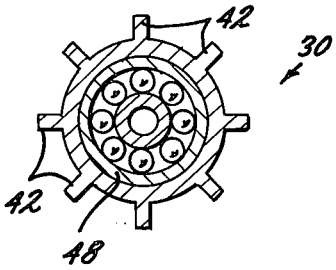
FIG. 6
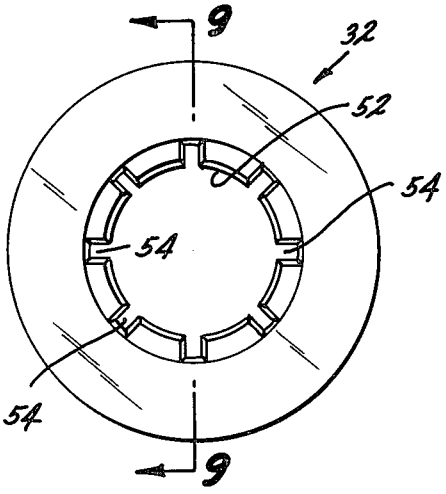
FIG. 7
FIG. 8
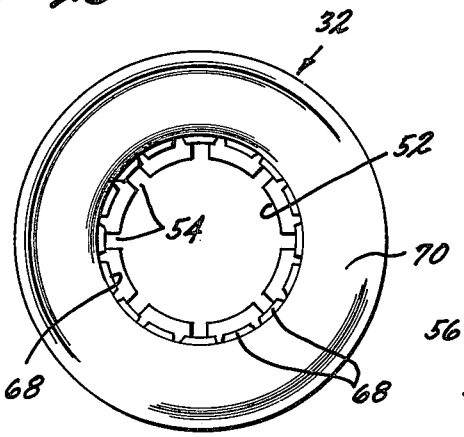
FIG. 9
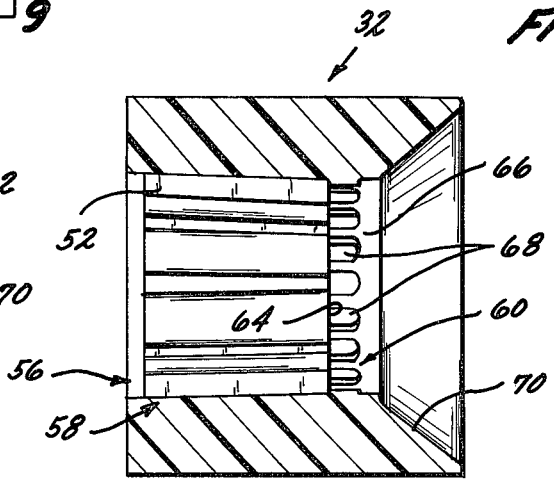

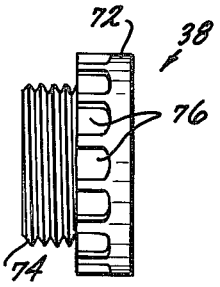
FIG. 10
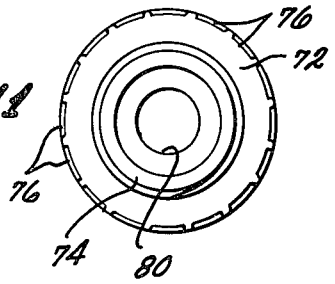
FIG. 11
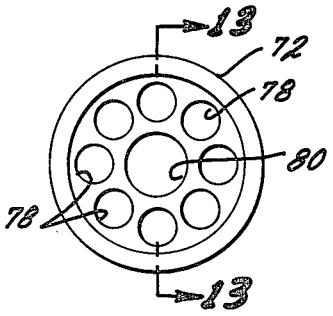
FIG. 12
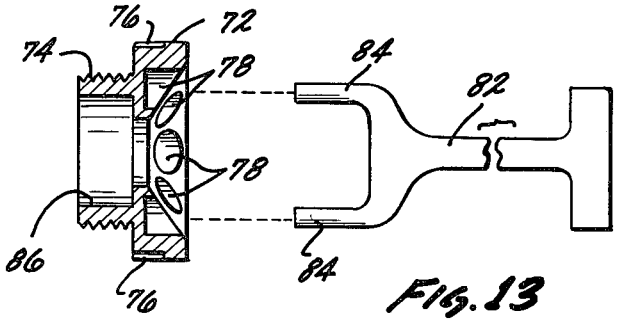
FIG. 13
FIG. 14
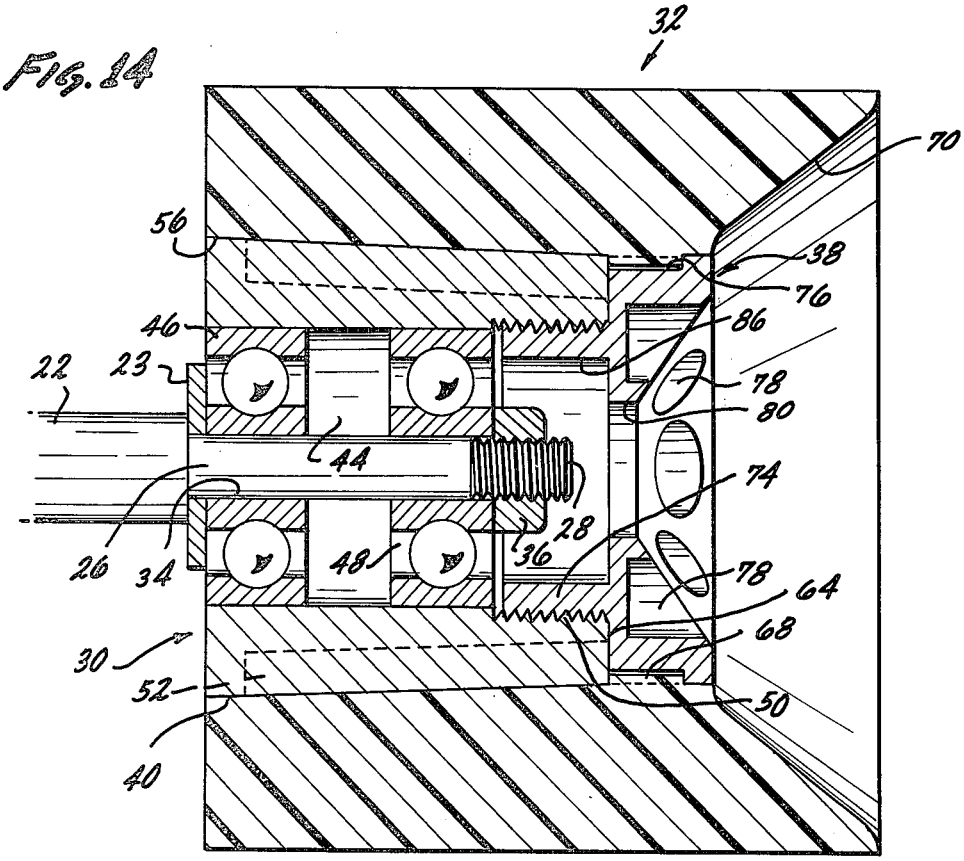

WHEEL ASSEMBLY FOR A SKATEBOARD OR THE LIKE

BACKGROUND OF THE INVENTION

The background of the invention will be discussed in two parts:

1. Field of the Invention

This invention relates to wheel assemblies and more particularly to a wheel assembly for a skateboard, roller skate, or the like.

2. Description of the Prior Art

With the rapid rise in popularity of the sport of skateboarding, many different types of construction of skateboards, skateboard trucks and wheels have been developed. Due to competitive skateboard events, speeds have increased and numerous refinements have been made in construction materials as well as construction techniques. Speeds for general usage of skateboards average fifteen miles per hour while in pure speed events, skateboard riders have recorded speeds in excess of sixty miles per hour. Consequently, wheel construction has become increasingly important. The most readily available wheel construction has a urethane tire with a central aperture having press fit therein ball bearings, or alternatively, the tire is molded around the bearings. Another type of construction utilizing urethane wheels incorporates a metal race within the aperture for the utilization of loose ball bearings. In either of these two constructions, the metallic portion comprises a diameter which is relatively small compared to the overall diameter of the wheel resulting in a thick tire. With construction of this type, at high speeds, the bearing portion tends to separate from the surrounding urethan due to the repeated flexing, and either effects slippage between the tire and the bearing portion, misalignment of the bearing with respect to the tire or complete separation of the tire from the bearing, resulting in unstable or unsafe operating conditions.

Furthermore, with current tires having very thick urethane construction, in order to provide such tires with sufficient traction, they are made of a very soft urethane material. That material deforms at rolling speeds just ahead of the contact point of the tire with the surface upon which it is rolling, resulting in the material bunching up or bulging forward during the rolling. As the material deforms and reforms, internal heat is being generated through internal friction, thereby slowing the wheel down.

Another wheel construction currently on the market is sold by Apex Sports Products of La Mirada, Calif., and is shown in the magazine "Skateboarder", Volume 3, No. 1, which has been submitted to the Patent Office by separate communication. This wheel assembly incorporates a larger diameter hub resulting in a thinner tire, which is secured to the hub by molding or bonding. The tire is non-removable and made from a harder composition of urethane. If it is chipped, gouged, scraped or worn out, the entire wheel must be replaced.

SUMMARY OF THE INVENTION

It is an object of this invention to provide a new and improved wheel assembly for a skateboard or the like.

It is another object of the invention to provide a new and improved wheel assembly having a replaceable tire.

The foregoing and other objects of the invention are accomplished by providing a wheel assembly including a hub having a central aperture with a bearing receiving end and an internally threaded end, the hub having a flange formed in the outer surface adjacent the bearing receiving end with a plurality of ribs extending longitudinally in the surface thereof from the flange toward the other end. A tire with a central aperture configured for mating engagement with the hub is provided, the aperture having an enlarged recess with a shoulder portion adjacent the end opposite the flange receiving end. A hub cap is provided with a threaded portion for engaging the threaded aperture of the hub and a cap portion configured for abutting against the shoulder and engaging the peripheral surface of the recess with this surface and the coacting cap surface being matingly detented to prevent loosening of the hub cap with the wheel secured to the hub by the hub cap.

The features of the present invention which are believed to be novel are set forth with particularity in the appended claims. The present invention, both as to its organization and manner of operation together with further objects and advantages thereof, may best be understood by reference to the following description when taken in conjunction with the accompanying drawings in which like-reference characters refer to like elements in the several views.

BRIEF DESCRIPTION OF THE DRAWINGS

FIG. 3 is a side elevation of the hub of the wheel assembly of FIG. 2;

FIG. 4 is an end view of the hub of FIG. 3;

FIG. 5 is a cross-sectional view taken along line 5—5 of FIG. 4;

FIG. 6 is a cross-sectional view of the hub taken along line 6—6 of FIG. 3;

FIG. 7 is a rear elevation of the tire of the wheel assembly of FIG. 2;

FIG. 8 is a front elevation of the tire;

FIG. 9 is a cross sectional view of the tire taken along line 9—9 of FIG. 7;

FIG. 10 is a side elevation of the hub cap of the wheel assembly of FIG. 2;

FIG. 11 is a rear elevation of the hub cap of FIG. 10;

FIG. 12 is a front elevation of the hub cap of FIG. 10;

FIG. 13 is a cross-sectional view of the hub cap taken along line 13—13 of FIG. 12 and showing a tool (partially broken away) for attaching the hub cap; and FIG. 14 is a cross-sectional view showing the wheel assembly in its assembled condition.

DESCRIPTION OF THE PREFERRED EMBODIMENT

Figure 1:
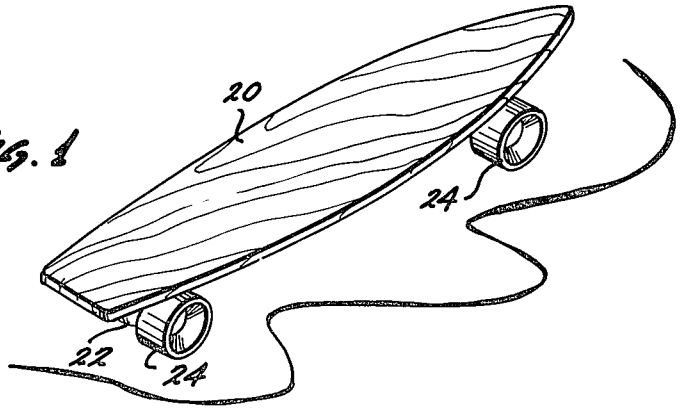
FIG. 1 is a perspective view of a skateboard.

Referring now to the drawings and particularly to FIG. 1, there is shown a skateboard including a board 20 adapted for supporting a rider, the board 20 being provided on the under surface thereof with skateboard trucks 22 (only one of which is shown), the trucks 22 containing axles for supporting a pair of wheels 24 on each of the trucks 22. Skateboards of this type originally started out as amusement devices with the wheels generally being of the type employed in roller skates. However, with the advent of competitive skateboarding events, the wheels have been subject to more abuse by higher speeds being attainable with the newer wheels designed for skateboards. The material composition now utilized generally for such skateboard wheels is urethane which is resilient and flexible while still maintaining a degree of rigidity and durability for the various surfaces on which the skateboard will be employed.

Figure 2:
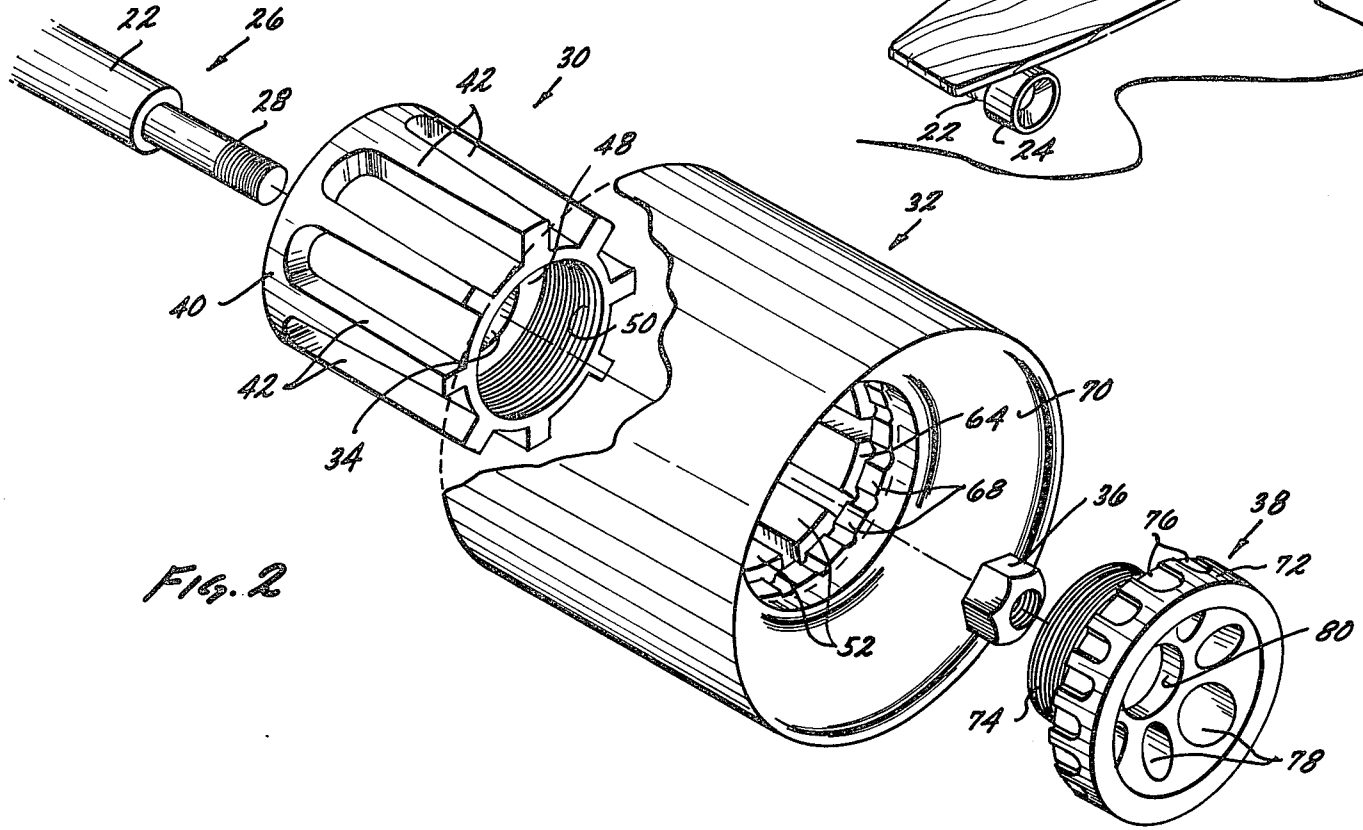
FIG. 2 is an exploded perspective view of the wheel assembly according to the invention.

Shown in FIG. 2 is a wheel assembly according to the invention which shows a partial skateboard truck 22 having an axle 26 with a threaded portion 28 at the free end thereof. A hub generally designated 30 receives over the outer surface thereof a removable tire generally designated 32. The hub 30 is mounted on the axle 26 with the axle 26 extending through a central aperture 34 with a locking nut 36 engaging the threaded portion of the axle 26. As will be discussed hereinafter, the aperture 34 contains suitable bearing means so that the hub 30 is rotatably mounted on shaft 26. The tire 32 is then suitably fitted on the hub 30 and a hub cap 38 is threadably received by a mating portion within aperture 34 of hub 30 to retain the assembly in position. As shown in FIGS. 2 through 6, the hub 30 is generally cylindrical in form and has a first end having a flange 40, this end being positioned on axle 26 with the flange 40 nearest the truck 22. Formed on the surface of the hub 30 is a plurality of longitudinally extending ribs 42, that is, in a direction in alignment with the axis of hub 30. As can be seen in FIGS. 4 and 6, in cross section, the ribs 42 extend radially outwardly from the surface of hub 30.

The aperture 34 (see FIG. 5) has a bearing receiving portion 44 adapted for receiving, in press fit relationship, a pair of precision ball bearings 46 and 48 with the aligned apertures thereof adapted for receiving the axle 26. The outer end of aperture 34 has an internally threaded portion 50 adapted to receive the hub cap 38. As can be seen, the bearings 46 and 48 are in metal-to-metal contact with the adjacent inner surface 44 of aperture 34 of hub 30 to provide a positive engagement of the bearings. While encased ball bearings are shown, it is to be understood that the bearing receiving portion 44 can be configured, by molding or by separate part, for containing a metallic race for receiving loose bearings if desired.

Referring now to FIGS. 2 and 7–9 the tire 32, which can be formed from a relatively soft urethane material, has a central aperture 52 which is circular with radially extending longitudinal grooves 54 configured for matingly engaging the ribs 42 of hub 30. The aperture 52 has three portions, a flange receiving recess portion 56, the grooves portion 58 and a slightly enlarged recess portion 60. The axial length of the flange portion 56 plus the grooves portion 58 is substantially identical to the axial length of hub 30, the flange 40 of hub 30 matingly fitting within flanged portion 56 when the ribs 42 of the hub 30 are in engagement with the grooves 54 of groove portion 58, the outer end of hub 30 terminating at approximately the juncture of the groove portion 58 with the recess portion 60. The aperture 52 is provided with a slight taper from the flange receiving end 56 toward the recess 60, the hub 30 being provided with a similar taper, although the tapering is not necessary to the invention.

As can be seen by comparing FIG. 4 with FIG. 8, the inner surface of aperture 52 is generally circular in cross section for receiving the main body portion of hub 30 which is similarly configured. Although a circular configuration is shown, the mating surfaces of hub 30 with aperture 52 and the corresponding ribs 42 and grooves 54 may have other configurations which effect a removable tire and the retention of the tire on the hub to prevent relative movement therebetween. This enables a user to change tires without the need for changing the entire wheel. Various wheels of different compositions may have different characteristics on different surfaces and the wheel assembly shown and described would permit the user to select the tires accordingly. Furthermore, since the tire is made of a composition which is less durable than the bearing and hub assembly, surface abrasions or chips in the tire are less expensively remedied by a change of the tire alone.

The recess portion 60 of tire 32 has a shoulder portion 64 formed by the adjacent end of the grooves portion 58 and a circular peripheral surface 66 which has formed therein a plurality of ridges 68 extending in an axial direction and disposed about the periphery of surface 66. The adjacent outer edge of tire 32 has an outwardly extending tapered portion 70.

Referring now to FIGS. 10–13 the hub cap 38 will be described and includes a cylindrical cap portion 72 and a reduced diameter threaded body portion 74, the threaded portion 74 being adapted to engage the internally threaded portion 50 of aperture 34 of hub 30. Formed within the cap 72 is a plurality of detents 76, the number of detents 76 corresponding to the number of ridges 68 formed within recess 60 of tire 32, although fewer detents could be utilized so long as at least a sufficient number of detents 76 engage the ridges 68 to prevent loosening.

Upon tightening down of the hub cap 38 on hub 30, the detents 76 ride over the ridges 68 formed within the recess 60 of the tire 32 in frictional engagement so that upon complete tightening of the hub cap 38, each of the ridges 68 will rest in a corresponding detent 76 to prevent hub cap 38 from loosening during operation of the wheel assembly. The threaded portions 74 can be identical for all four wheels by the utilization of the configuration as shown with the mating detent and ridge arrangement which prevents loosening. In this way, right hand threads and left hand threads are not necessary for opposite sides of the skateboard.

The outer exposed surface of hub cap 38 is provided with a plurality of axially extending recesses 78 and a central aperture 80, the recesses 78 and aperture 80 providing an esthetically pleasing exterior appearance which is in the nature of a "mag wheel". In addition to the esthetic nature of recesses 78, as shown in FIG. 13, a wheel tool 82 is provided with a handle portion and a pair of prongs 84 configured for fitting within diametrically opposite recesses 78 to enable the user to assemble the hub cap 38 to the wheel assembly. The inner surface of the hub cap 38 is provided with an enlarged opening 86, which is slightly larger than the lock nut 36, which secured the hub 30 to the axle 26.

Referring now to FIG. 14, the wheel assembly is shown in cross section in the assembled condition with the hub 30 mounted on shaft 26 of truck 22 with a washer 23 interposed therebetween. The hub 30 is maintained in position by the lock nut 36 engaging the threaded portion 28 of axle 26. The tire 32 is then fitted over hub 30 with the grooves 54 thereof engaging the ribs 42 and the flange receiving portion 56 of aperture 52 of tire 32 abutting against flange 40 of hub 30. The hub cap 38 has the threaded portion 74 thereof engaging the internally threaded portion 50 of the hub aperture 34 until the circular shoulder of cap portion 72 abuts against the end surface of hub 30. At this point, the detents 76 about the periphery of cap portion 72 matingly engage the ridges 68 formed on the circular surface of the enlarged recess 60 of the tire 32 for frictional retention therein. As can be seen, the hub cap 38, the hub 30 and the tire 32 rotate as a unit about the axle 26 by means of the bearings 46 and 48. The resulting wheel assembly is capable of having the tire 32 removed and readily interchanged with other tire members of different material construction, or if desired, of different colors. With the bearings 46 and 48 positioned within the central aperture of the metal hub 30, the likelihood of misalignment or separation of the bearings from the hub 30 is greatly minimized if not substantially eliminated. The length of hub 30 is such to substantially fully support the load-bearing portion of tire 32. Additionally, due to the large amount of hub 30 surface coacting with the tire 32 by means of the ribs 42, a positive non-adhesive bond is established between the tire 32 and hub 30, which improves the riding qualities of the wheel assembly shown. Furthermore, because of the large amount of outer surface area of the hub 30 and the ribs 42 heat generated by the roller bearing 46 and 48 is dissipated more readily due to the large mass of metal. The material composition of tire 32 is relatively soft urethane with the amount of thickness of the material in tire 32 between the hub 30 and the periphery of tire 32 being reduced, thereby resulting in a tire 32 which provides good traction and resists deformation during high speed operation resulting in a more stable wheel assembly than that heretofor provided.

While there has been shown and described a preferred embodiment, it is to be understood that various other adaptations and modifications may be made within the spirit and scope of the invention.

What is claimed is:

1. In a wheel assembly for a skateboard or the like, the combination comprising:

a hub having a central aperture with a bearing receiving end and an internally threaded end, the outer surface of said hub being provided with a plurality of spaced longitudinally extending ribs and a flange adjacent said bearing receiving end;

a tire of a generally flexible material having a central aperture with a main portion and an enlarged recess, said main portion having grooves slidably engaging the ribs on the outer surface of said hub to prevent relative rotation therebetween; and a hub cap having a threaded portion and a cap portion having generally the same diameter as said recess, said threaded portion engaging the threaded end of said hub, said recess being provided with radially inwardly extending integral detent means about the periphery thereof and said cap portion being provided with radially projecting ridge means of a length to engage and resiliently distort said detent means when rotating said threaded portion relative to said threaded end whereby to secure said tire to said hub and prevent loosening of said hub cap.

2. The combination according to claim 1 wherein said hub outer surface and said tire central aperture are generally circular in cross section.

3. The combination according to claim 2, further including ball bearings within said bearing receiving end of the central aperture of said hub.

4. The combination according to claim 3 wherein said cap portion of said hub cap is provided with at least two axially extending recesses on the outer surface thereof for receiving a tool for rotating said hub cap to assemble said wheel assembly.

* * * * *